US009117556B2

(12) United States Patent
Yamamoto

(10) Patent No.: US 9,117,556 B2
(45) Date of Patent: Aug. 25, 2015

(54) METHOD FOR WASTE BURIAL AND CONTAINER FOR WASTE STORAGE

(71) Applicant: YAMAMOTO FOUNDATION WORKS CO., LTD., Yamanashi (JP)

(72) Inventor: Takekazu Yamamoto, Yamanashi (JP)

(73) Assignee: YAMAMOTO FOUNDATION WORKS CO., LTD., Yamanashi (JP)

( * ) Notice: Subject to any disclaimer, the term of this patent is extended or adjusted under 35 U.S.C. 154(b) by 0 days.

(21) Appl. No.: 14/128,110

(22) PCT Filed: Feb. 19, 2013

(86) PCT No.: PCT/JP2013/053911
§ 371 (c)(1),
(2) Date: Dec. 20, 2013

(87) PCT Pub. No.: WO2014/013746
PCT Pub. Date: Jan. 23, 2014

(65) Prior Publication Data

US 2014/0309472 A1 Oct. 16, 2014

(30) Foreign Application Priority Data

Jul. 17, 2012 (JP) ..... 2012-158542

(51) Int. Cl.
*G21F 5/00* (2006.01)
*G21F 9/00* (2006.01)
(Continued)

(52) U.S. Cl.
CPC *G21F 9/008* (2013.01); *G21F 9/24* (2013.01); *G21F 9/34* (2013.01); *G21F 9/36* (2013.01); *G21F 5/14* (2013.01)

(58) Field of Classification Search
CPC ..... G21F 9/34; G21F 9/24; G21F 9/008
See application file for complete search history.

(56) References Cited

U.S. PATENT DOCUMENTS 4,316,814 A * 2/1982 Uerpmann ..... 588/17
4,845,372 A * 7/1989 Mallory et al. ..... 250/506.1
(Continued)

FOREIGN PATENT DOCUMENTS

JP 09-061594 A 3/1997
JP 11-038191 A 2/1999
(Continued)

OTHER PUBLICATIONS

Office Action dated Sep. 29, 2014 in connection with corresponding application No. 10-2013-7029667.
(Continued)

*Primary Examiner* — John Kreck
(74) *Attorney, Agent, or Firm* — Browdy and Neimark, PLLC

(57) ABSTRACT

A method for waste burial includes preparing metallic containers (11) for waste storage each being configured to contain drum cans (12) in each of which waste is contained, and being sealed; drilling a vertical hole (26) to bury a plurality of the containers (11) for waste storage in a ground (20), thereafter disposing a steel pipe (27) in the vertical hole (26); providing a concrete base (30) on a lower portion of the steel pipe (27), thereafter disposing the container (11) for waste storage on the concrete base (30), and thereon stacking a plurality of the containers (11) for waste storage; and sealing an upper portion of the uppermost container (11) for waste storage with a concrete (34), after stacking the containers (11) for waste storage from the ground (20) to a predetermined depth.

10 Claims, 11 Drawing Sheets

(51) Int. Cl.

| | |
|---|---|
| ***G21F 9/24*** | (2006.01) |
| ***G21F 9/36*** | (2006.01) |
| ***G21F 9/34*** | (2006.01) |
| *G21F 5/14* | (2006.01) |

(56) References Cited

U.S. PATENT DOCUMENTS

| | | | | |
|---|---|---|---|---|
| 4,972,087 | A * | 11/1990 | Neider et al. | 250/507.1 |
| 5,338,493 | A * | 8/1994 | Welch | 588/16 |
| 5,489,739 | A * | 2/1996 | Curry et al. | 588/250 |
| 6,660,972 | B1 * | 12/2003 | Georgii | 219/385 |
| 2007/0274430 | A1 * | 11/2007 | Chiocca | 376/412 |
| 2011/0036836 | A1 | 2/2011 | Lantheaume | |

FOREIGN PATENT DOCUMENTS

| | | | |
|---|---|---|---|
| JP | 2002-107492 | A | 4/2002 |
| JP | 2004-163165 | A | 6/2004 |
| JP | 4253783 | B2 | 4/2009 |
| JP | 2010507791 | A | 3/2010 |
| JP | 4687971 | B2 | 5/2011 |
| KR | 10-20100097821 | A | 4/2010 |
| KR | 100964796 | B1 | 6/2010 |

OTHER PUBLICATIONS

Korean Intellectual Property Office Decision of Final Rejection of the counterpart Korean Appln. No. 10-2013-709667 dated Apr. 15, 2015.

* cited by examiner

11…container for waste storage
12…drum can (sealed case)
20…ground
26…vertical hole
27…steel pipe
30…concrete base
34…concrete

METHOD FOR WASTE BURIAL AND CONTAINER FOR WASTE STORAGE

TECHNICAL FIELD

The present invention relates to a method for waste burial and a container for waste storage to bury radioactive wastes or other industrial wastes in a ground.

BACKGROUND ART

Industrial wastes discharged from a factory are sealed in a sealed container such as a drum can and so on and are treated by burying the sealed container in a ground. In particular, with respect to radioactive wastes, in some cases, there is adopted a method in that wastes are solidified by mortar and contained in a metallic container such as a drum can, thereafter the container is surrounded by a filling material, and the filling material is solidified by a concrete structure, and the filling material solidified by the concrete structure is buried in a ground (Patent Document 1).

In addition, when burying the radioactive wastes in the ground, there are disclosed a method for burial and so on in which a storage chamber having a certain largeness is formed in the ground, and containers each containing the waste are sequentially carried in the storage chamber through a vertical hole drilled from a surface of the ground (Patent Document 2).

RELATED ART

Patent Documents

Patent Document 1: Japanese Patent Application Publication No. H11-38191.

Patent Document 2: Japanese Patent Application Publication No. H9-61594.

SUMMARY OF THE INVENTION

Technical Problems

Methods for waste burial disclosed in the aforementioned patent documents are configured to bury hermetically dangerous radioactive waste in the ground. Therefore, if a large amount of wastes are generated, a broad place far from town is required to treat the wastes. However, it is often difficult to ensure such a broad place. In particular, if a large-scale earthquake occurs and affects on an atomic energy plant, there is possibility that a large amount of nubbles contaminated by a radioactive material are generated, it is necessary to perform treatment such as burial of the nubbles safely and rapidly.

In this way, in the conventional methods for burial, a broad place is required to store the wastes. In addition, special facilities and equipment are required to bury the wastes and store the wastes. Consequently, there is a problem that a long work period and a high cost are required.

Therefore, an object of the present invention is to provide a method for waste burial and a container for waste storage capable of performing burial treatment of wastes at a low cost and in a short period without requiring a broad place even if a large amount of radioactive wastes are generated.

Solution to Problems

To accomplish the above object, a method for waste burial of the present invention includes preparing metallic containers for waste storage each being configured to contain sealed cases in each of which waste is contained, and being sealed; drilling a vertical hole to bury a plurality of the containers for waste storage in a ground, thereafter disposing a steel pipe in the vertical hole; providing a concrete base on a lower portion of the steel pipe, thereafter disposing the container for waste storage on the concrete base, and thereon stacking a plurality of the containers for waste storage; and sealing an upper portion of the uppermost container for waste storage with a concrete, after stacking the containers for waste storage from the ground to a predetermined depth.

In addition, a container for waste storage according to the present invention includes a bottom portion and a body portion to be containable at least two sealed cases in each of which waste is housed in the container, in a vertical direction, a lid portion to seal an upper portion of the body portion, and a positioning connector including an engagement concave portion provided on either one of the bottom portion and the lid portion and an engagement convex portion provided on the other of the bottom portion and the lid portion so that a plurality of the containers are stacked in a vertical direction.

Advantageous Effects of the Invention

As mentioned above, according to the method for waste burial of the present invention, because the containers for waste storage in which wastes are sealed are buried in the stacked state in the vertical holes formed by drilling deeply the ground, it is possible to treat a large amount of wastes even if a place is narrow. In addition, the waste is contained in the sealed case, and the sealed case is hermetically contained in the container for waste storage. Furthermore, a plurality of containers for waste storage is contained in the stacked state in the steel pipe buried in the ground, and is sealed by the concrete. Therefore, radioactive substances and so on included in the wastes do not leak to an outside.

Because usual facilities or equipment used in foundation constructions of conventional buildings can be used for the method for waste burial, it is possible to perform burial treatment of a large amount of nubbles and so on generated in earthquake and so on at a low cost and in a short period.

Furthermore, after the containers for waste storage are buried, even if they are retrieved after a few years or a few decades, the containers for waste storage hermetically contained to be stacked in the steel pipe can be drawn up easily by the electromagnetic absorption portion provided in the crane. Thereby, it is possible to bury again the containers for waste storage temporarily buried for the reason that the securement of a place for waste burial is difficult and to move them to other places for retreatment and so on.

According to the container for waste storage of the present invention, because the waste is contained in the sealed case such as the drum can, the sealed case is sealed with the bottom portion, the body portion and the lid portion which are made of a steel plate having a predetermined thickness, it is possible to prevent effectively the radioactive substances included in the waste from leaking to an outside. In addition, it is possible to stack the containers in a vertical direction without being misaligned, because the engagement convex portion and the engagement concave portion are provided on the bottom portion and the lid portion, respectively.

DESCRIPTION OF EMBODIMENTS

Embodiments of a method for waste burial and a container for waste storage according to the present invention will be explained hereinafter in detail with reference to the accompanying drawings.

Figure 1:
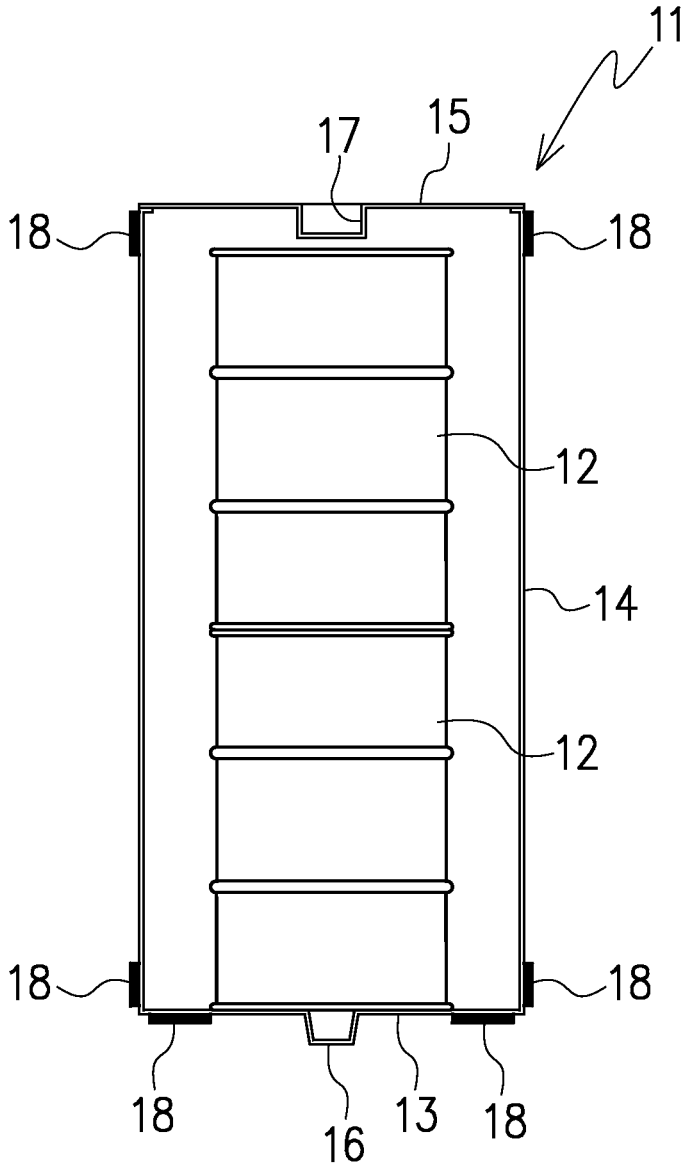
FIG. 1 is a transparent sectional view showing an inner portion of a container for waste storage according to the present invention.
Figure 2:
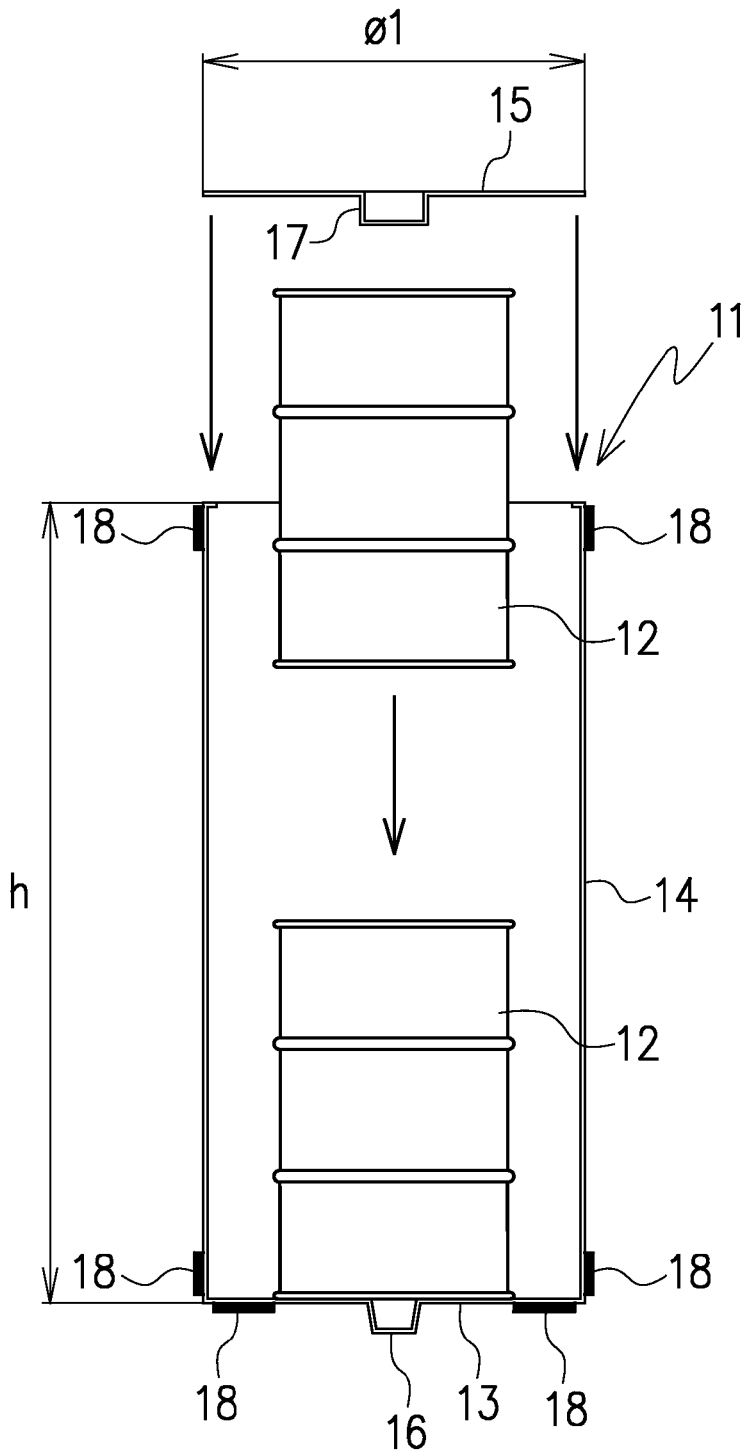
FIG. 2 is an exploded transparent view of the container for waste storage.

FIGS. 1 and 2 illustrate a structure of the container 11 for waste storage used for the method for waste burial according to the present invention. The container 11 for waste storage is formed by a bottom portion 13 on which a plurality of sealed cases 12 (drum cans) in each of which radioactive wastes or industrial wastes are housed are disposed, a cylindrical body portion 14 provided integrally with the bottom portion 13 and having a height capable of housing at least two drum cans 12 in a vertically stacked state, and a lid portion 15 attached to an upper portion of the body portion 14 to seal the body portion. The bottom portion 13, the body portion 14 and the lid portion 15 are made of a steel plate having a thickness of about 6 (mm) or more. Each of the bottom portion 13 and the lid portion 15 has a diameter (φ 1) of about 1 (m) or less. In a case of arranging two drum cans 12 each having a usual size in a vertically stacked state, a height (h) is set to be about 2 (m). The lid portion 15 is attached to an upper end of the body portion 14 to seal to the body portion after the drum cans 12 are housed in the container.

In addition, a positioning connector is provided. The positioning connector is formed by an engagement convex portion 16 and an engagement concave portion 17, respectively is provided on a central portion of each of the bottom portion 13 and the lid portion 15. The engagement convex portion 16 and the engagement concave portion 17 are formed by pressing the bottom portion 13 and the lid portion 15 respectively after surrounding the bottom portion 13 and the lid portion 15 respectively by a mold. The engagement convex portion 16 and the engagement concave portion 17 can position simplify a plurality of the containers for waste storage in stacking them and prevent the stacked containers from being misaligned.

An upper end and a lower end of an outer surface of the body portion 14 and a circumferential portion of the outer surface of the bottom portion 13 are covered with a rubber member 18. The rubber member 18 has a predetermined thickness and made of a non-metallic material having an elasticity. This is because, in a case of containing the plurality of containers for waste storage in a steel pipe by use of a crane in a process which is described hereinafter, one container for waste storage is prevented from being absorbed to adjacent container 11 for waste storage when absorbing each container 11, and each container is prevented from being absorbed to an inner circumferential surface of the steel pipe, thereby operations of inserting the containers in the steel pipe and drawing out the containers from the steel pipe are simplified. In addition, the rubber member 18 provided on the bottom portion 13 has an advantageous effect of absorbing an impact in stacking the containers for waste storage.

Figure 3:
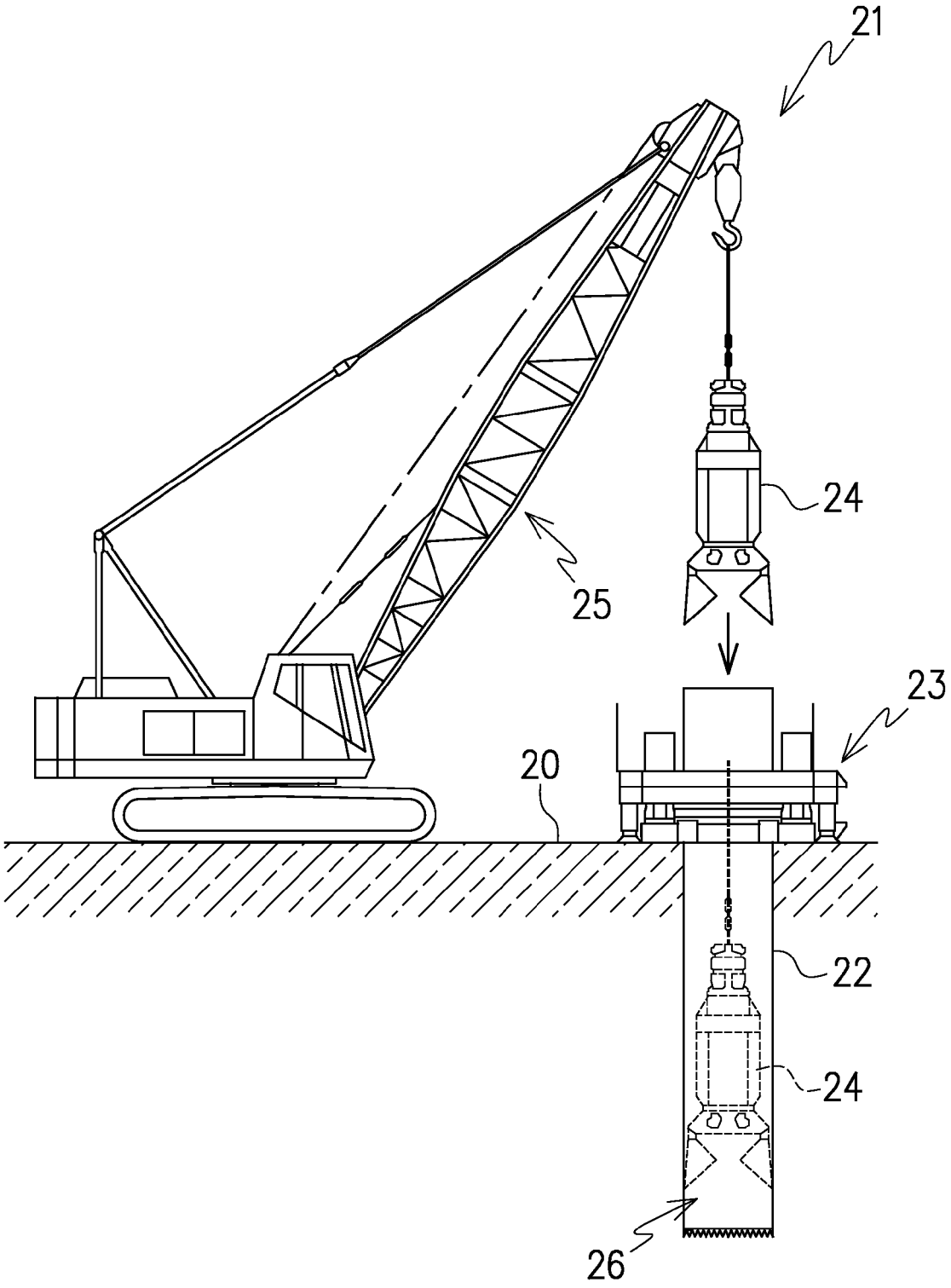
FIG. 3 is a process view showing a method of drilling a vertical hole.

Next, processes of performing a method for waste burial using the container for waste storage are described with reference to FIGS. 3 to 9. First, as shown in FIG. 3, an equipment 21 for foundation construction is carried in and set at a planned place for waste burial. The equipment 21 includes a casing 22, a casing fixing member 23 to drive the casing 22 in the ground 20, a hammer grab 24 inserted in the casing 22 and configured to drill the ground 20, and a crane 25 to set the casing 22 and hold suspending of the hammer grab 24. The drilling operation is configured to form a vertical hole 26 having a depth of about few dozen meters (m) so that a steel pipe 27 described hereinafter is set by digging out clod and stones and so on in the casing 22 by the hammer grab 24 while inserting the casing 22 in the ground 20, similarly to a foundation construction of a usual building.

Figure 4:
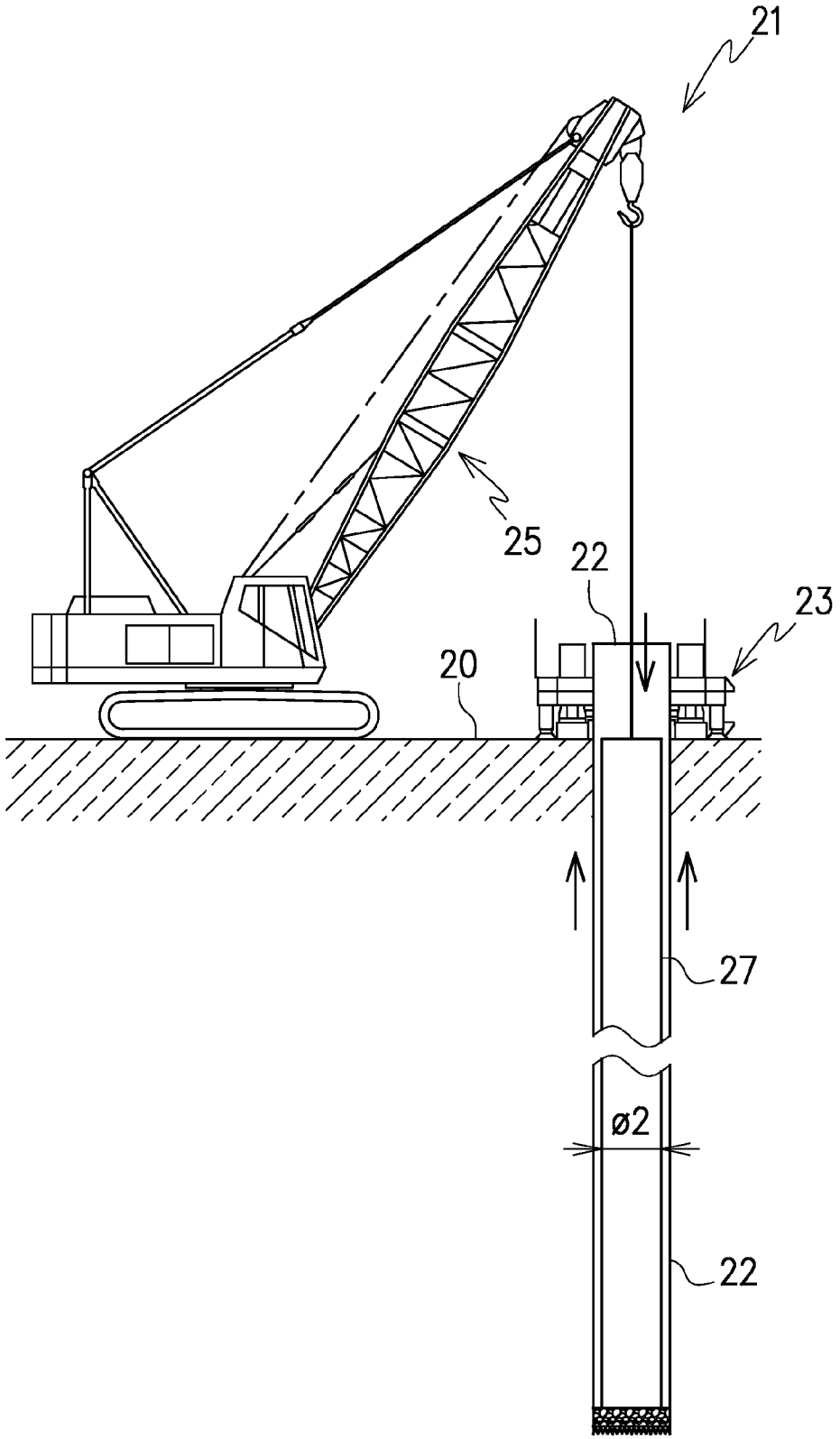
FIG. 4 is a process view showing a method of arranging a steel pipe.

After the vertical hole 26 reaches a predetermined depth, as shown in FIG. 4, the steel pipe 27 is carried by the crane 25 along an inner side surface of the casing 22 being inserted in the ground 20 by drilling. The steel pipe 27 is formed to have a length reaching a bottom portion of the vertical hole 26 from a surface of the ground 20, an outer diameter smaller than that of the casing 22, and an inner diameter (φ 2) of about 1.2 (m) capable of inserting the container 11 for waste storage. At the same time when the steel pipe 27 is inserted and set the ground 20, the casing 22 is drawn upward by the casing fixing member 23.

Figure 5:
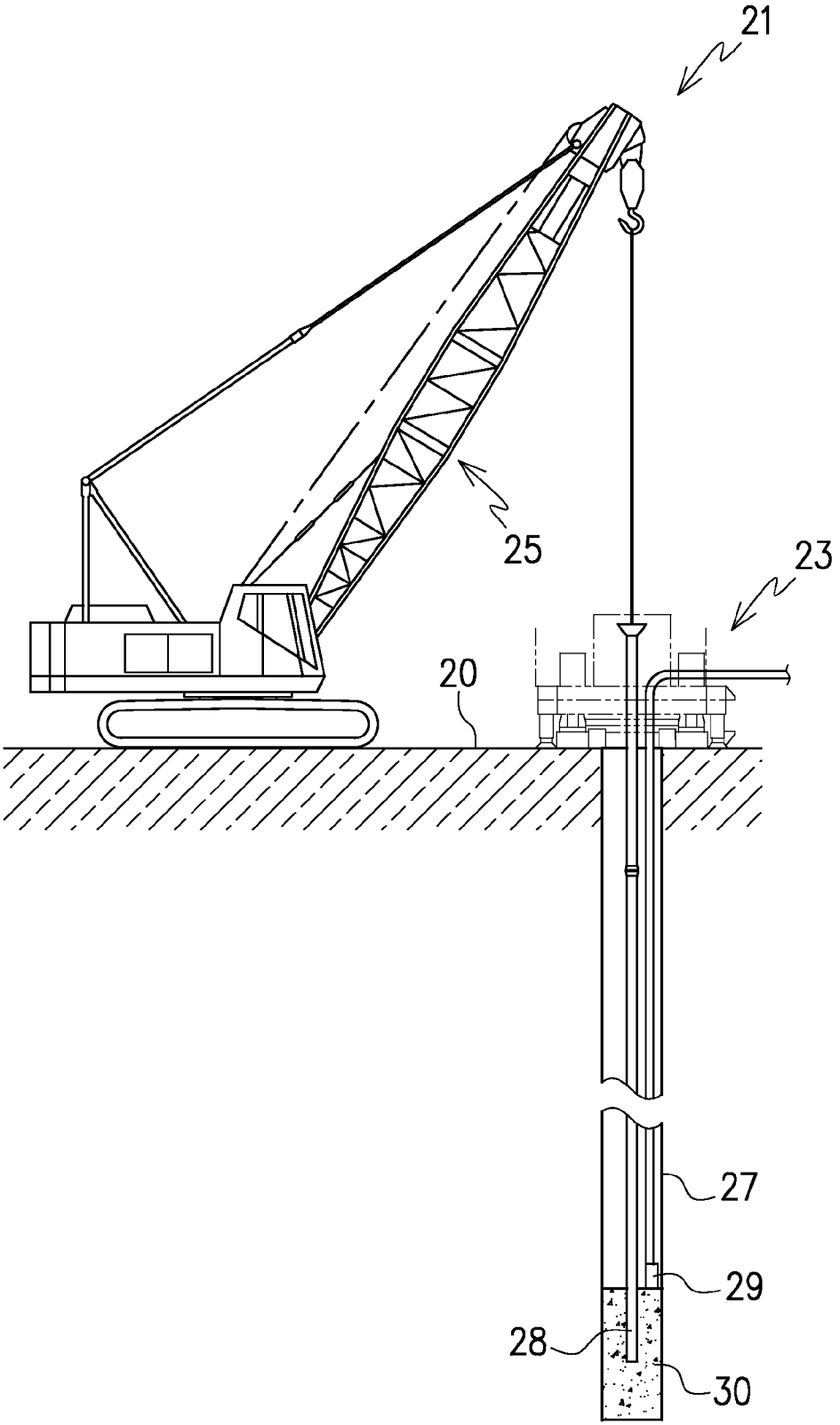
FIG. 5 is a process view showing a method of forming a concrete base in the steel pipe.

After the drawing up of the casing 22, a tremie pipe 28 is inserted by the crane 25 in the steel pipe 27 fixed to the vertical hole 26, as shown in FIG. 5. Then, concrete is flown in a bottom portion of the steel pipe 27 through the tremie pipe 28 to form a concrete base 30 having a height of about 2 (m). In forming the concrete base 30, excessive water is discharged to an outside through a drainage pipe 29 inserted simultaneously with the tremie pipe 28.

Figure 6:
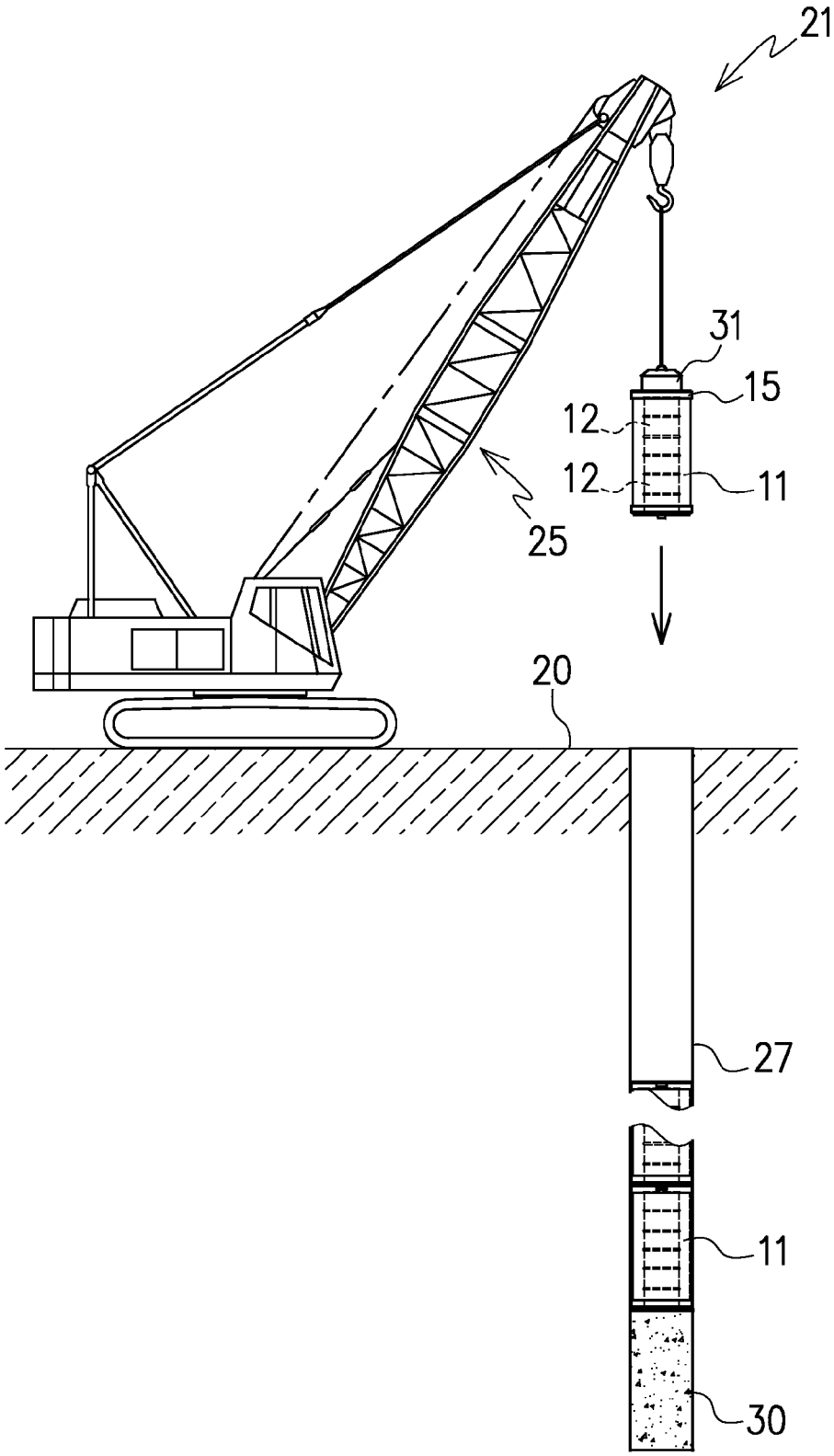
FIG. 6 is a process view showing a method of carrying sequentially containers for waste storage in the steel pipe.
Figure 7:
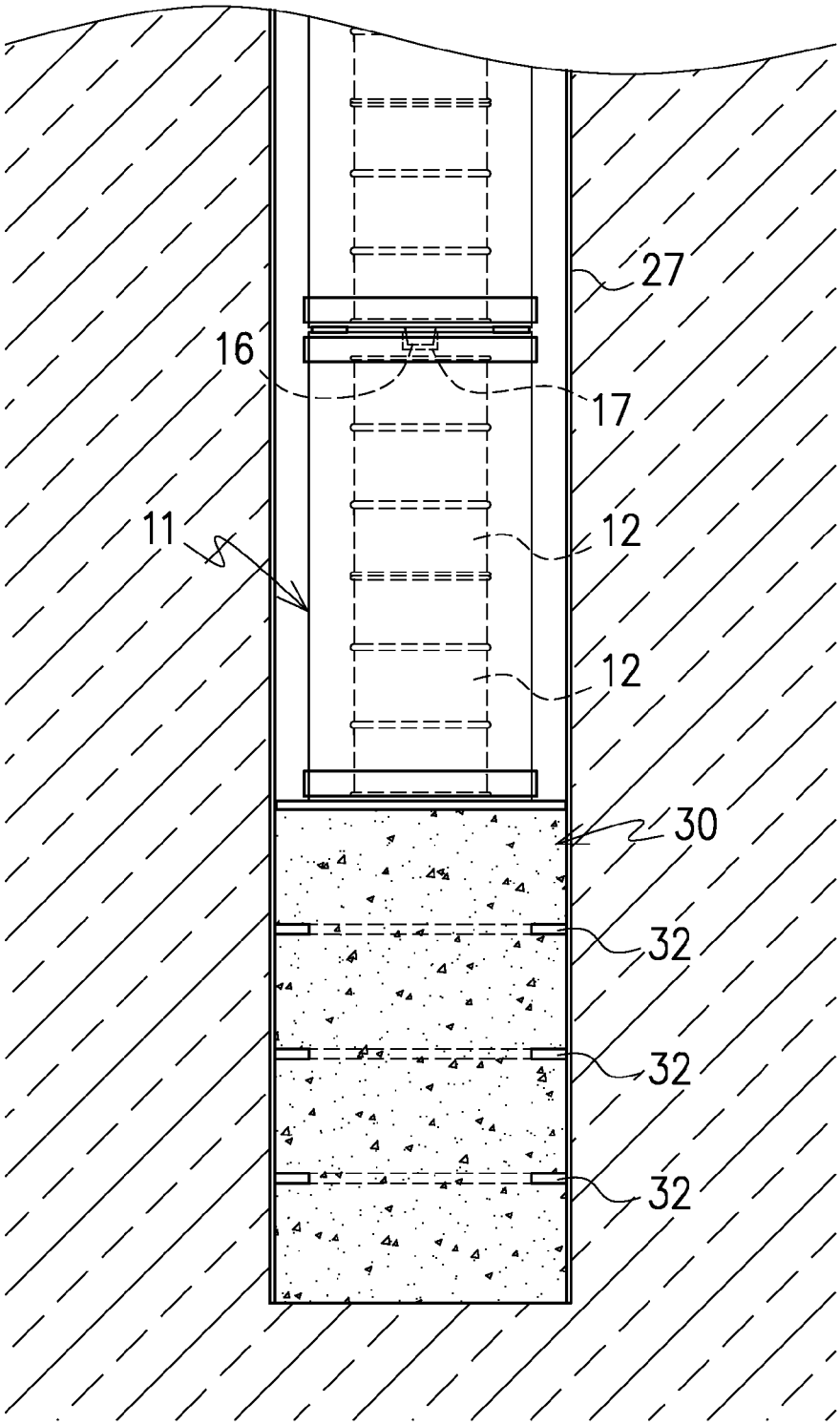
FIG. 7 is a sectional view showing a lower portion of the inner portion of the steel pipe in which the containers for waste storage are carried.

After the concrete base 30 is solidified, the containers 11 for waste storage are inserted one by one in the steel pipe 27 in each of which the drum can is hermetically contained, as shown in FIG. 6. Each of the containers 11 for waste storage is inserted in the steel pipe 27 in a state absorbing the lid portion 15 by an electromagnetic absorption portion 31 suspended from the crane 25, and thereafter, is carried in the steel pipe 27 by removing an electromagnetic force of the electromagnetic absorption portion 31. The carrying operation is that the engagement convex portion 16 provided on the bottom portion 13 of the upper container 11 for waste storage is fitted in the engagement concave portion 17 provided in the lid portion 15 of the lower container 11 for waste storage, thereby the containers 11 for waste storage are sequentially stacked. FIG. 7 illustrates a section of a lower portion of the steel pipe 27 in which the containers 11 for waste storage are carried. Because the initially carried container 11 for waste storage is directly placed on the concrete base 30, the bottom portion 13 of the initially carried container 11 has a flat surface which has no engagement convex portion 16.

A plurality of ring-shaped water stop protrusions 32 which are disposed at intervals in an up and down direction and protrude inward along a circumferential direction are provided on an inner circumferential surface of the steel pipe 27, in which the concrete base 30 is formed. The water stop protrusions 32 are formed of a hard rubber member, and have a role to prevent liquid from the ground and liquid exuded from the concrete from being introduced in the steel pipe through the upper surface of the concrete base 30. In this way, preventing the liquid from being introduced in the steel pipe 27 makes it possible to prevent the containers 11 for waste storage and the drum cans 12 contained therein from being corroded and seal the wastes safely. Note that it is possible to improve further a waterproof effect of a surface on which the container 11 for waste storage is placed by forming asphalt having waterproof effect on the upper surface of the concrete base 30.

As mentioned above, each of the containers 11 for waste storage is carried in the steel pipe 27 in an absorbed state by electromagnetic absorption part 31, while the containers are carried in and out of the steel pipe 27 smoothly without being absorbed an inner wall surface of the steel pipe 27 by the rubber member 18 provided on the upper end and the lower end of the outer surface of the body portion 14 and the circumferential portion of the outer surface of the bottom portion 13. In addition, the rubber member 18 makes it possible to absorb an impact generated when placing the containers for waste storage.

Figure 8:
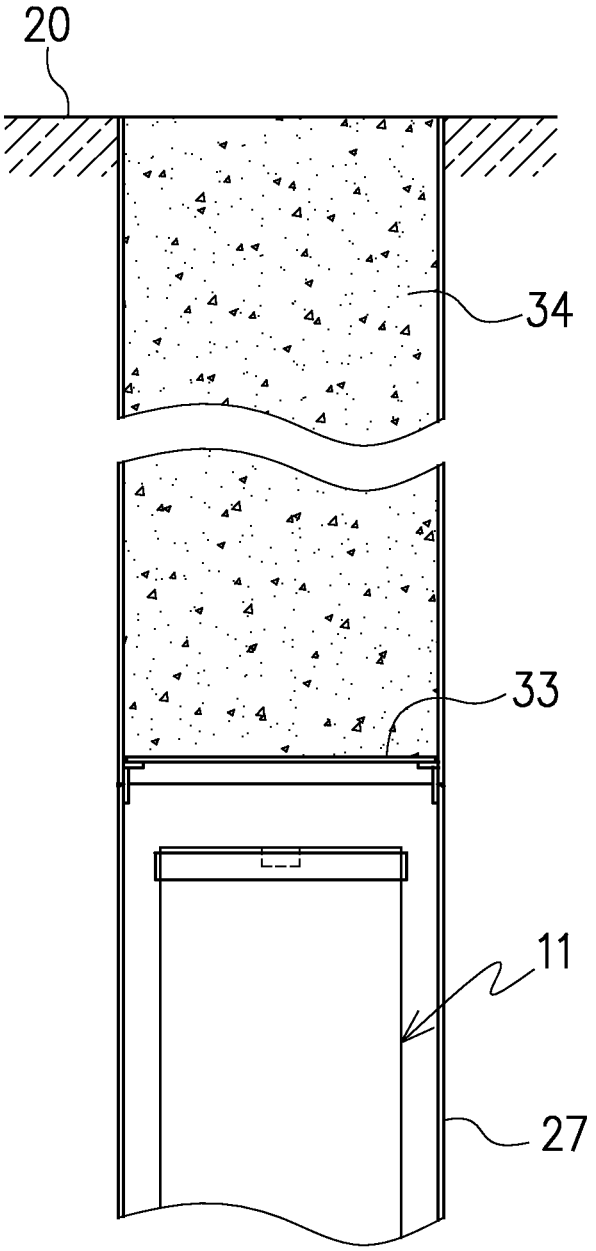
FIG. 8 is a sectional view showing an upper portion of the inner portion of the steel pipe in which the containers for waste storage are carried.

The installation of the containers 11 for waste storage is completed at the time when the final container 11 for waste storage is positioned at a depth of about 3 (m) under the ground 20. As shown in FIG. 8, a metallic sealing cover 33 having the same diameter as that of the steel pipe 27 is inserted in the steel pipe 27. The sealing cover 33 is welded to the inner circumferential surface of the steel pipe 27 above the uppermost container for waste storage which is finally installed so that a space containing a plurality of containers for waste storage is sealed. Thereafter, a concrete 34 for sealing is applied on the sealing cover 33 to seal completely the steel pipe 27 by integrating the upper end of the steel pipe 27 with the ground. The use of the sealing cover 33 makes it possible to prevent the concrete 34 for sealing from dropping in the steel pipe 27 and retrieve the containers 11 for waste storage in the steel pipe 27 after a few years or a few decades.

Figure 9:
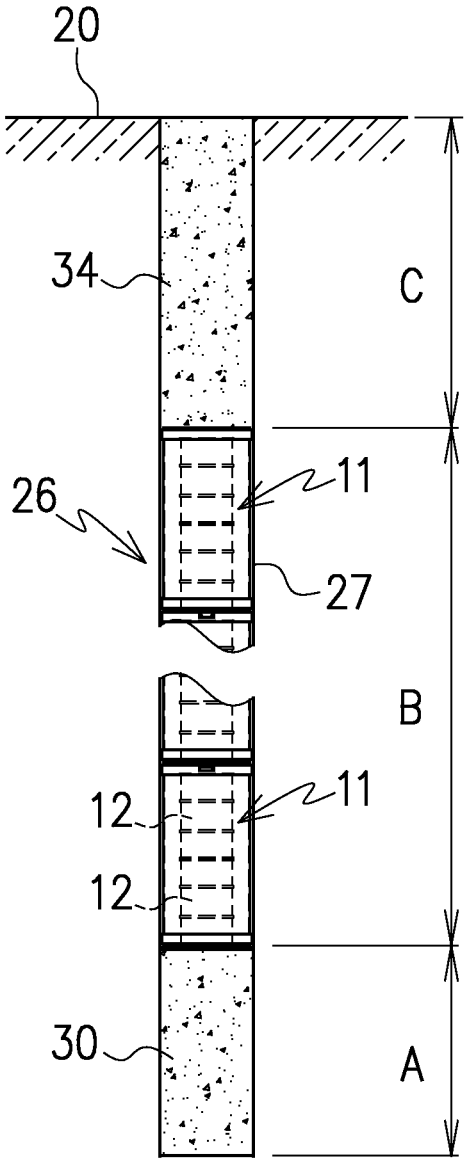
FIG. 9 is a sectional view showing a structure of the entire vertical hole.

As shown in FIG. 9, by the processes as mentioned above, the formed vertical hole 26 is formed to include a concrete base portion A, a stacking portion B of the containers 11 for waste storage, and a concrete sealing portion C. In an embodiment of the present invention, an entire depth of the vertical hole 26 has about 53 (m) as an example to apply a technology of foundation construction to build a building and so on. If the vertical hole has this depth, a depth of the stacking portion B of the containers for waste storage excepting the concrete base portion A of about 2 (m) and the concrete sealing portion C of about 3 (m) from the ground is secured into about 48 (m). Consequently, it is possible to bury twenty five containers 11 for waste storage (fifty drum cans). In addition, the vertical hole 26 can be provided at intervals of about 1-2 (m). In this way, because the containers can be housed in the vertical hole buried to have a predetermined depth by laying sequentially the containers in the vertical hole, it is possible to process effectively wastes even in a narrow land in which a buried place is limited.

In addition, with the foregoing processes, the wastes housed in the drum cans 12 can be closed hermetically in the metallic containers 11 for waste storage, and the containers 11 can be stacked in the steel pipe 27 placed in the ground. In addition, the upper portion and the bottom portion of the steel pipe 27 are sealed by the concrete portions each having a predetermined thickness. In this way, the vertical hole has the at least three-layer sealing structure. Therefore, even if the wastes are radioactive, the wastes do not leak to an outside easily. Consequently, even if the wastes are low-level radioactive wastes as well as usual industrial wastes, after burial of wastes, the ground can be used as a foundation of a building, on which conventional houses or high-rise buildings can be built.

Figure 10:
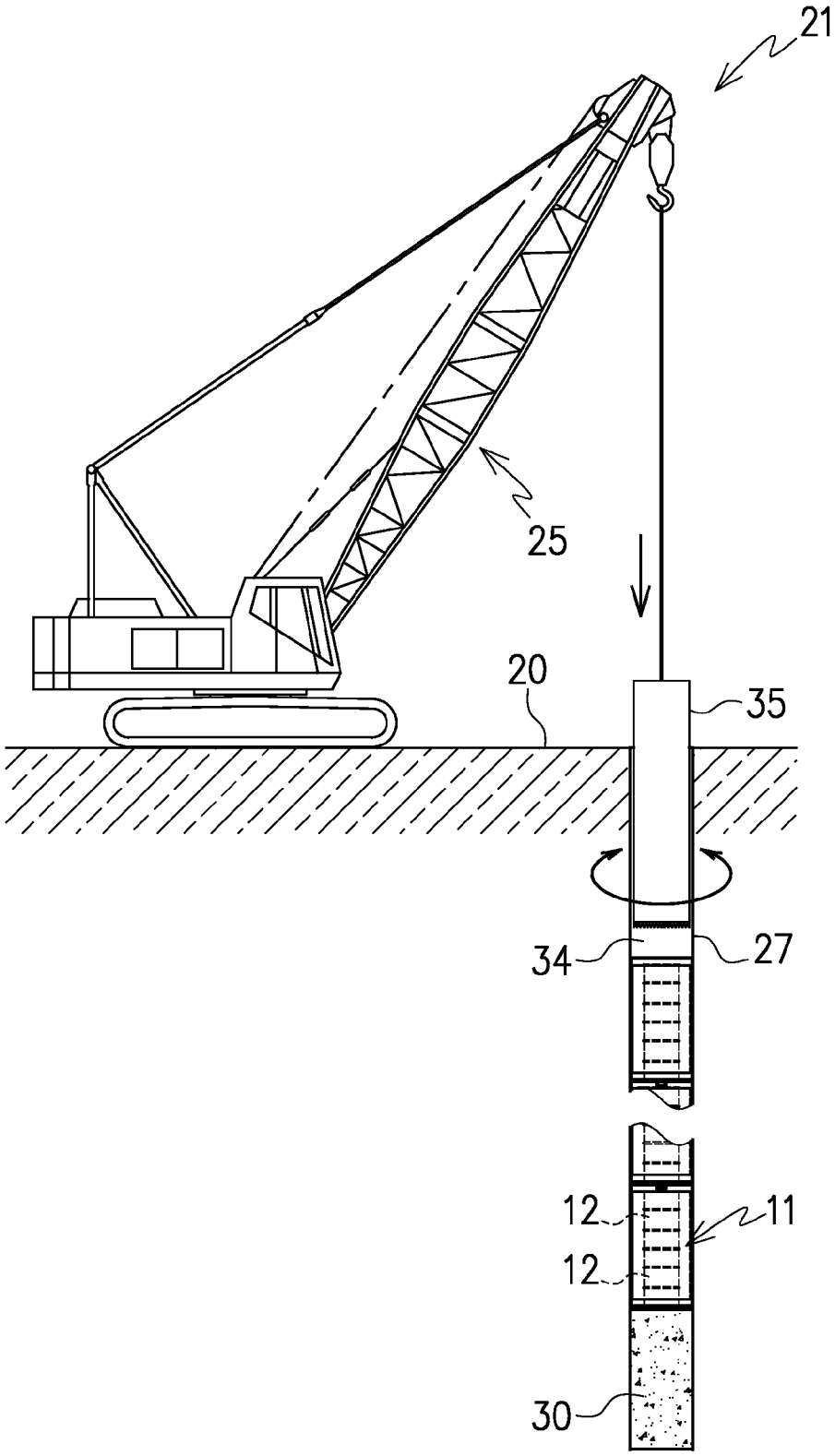
FIG. 10 is a process view showing a method of removing a sealing concrete at an upper portion of the steel pipe.
Figure 11:
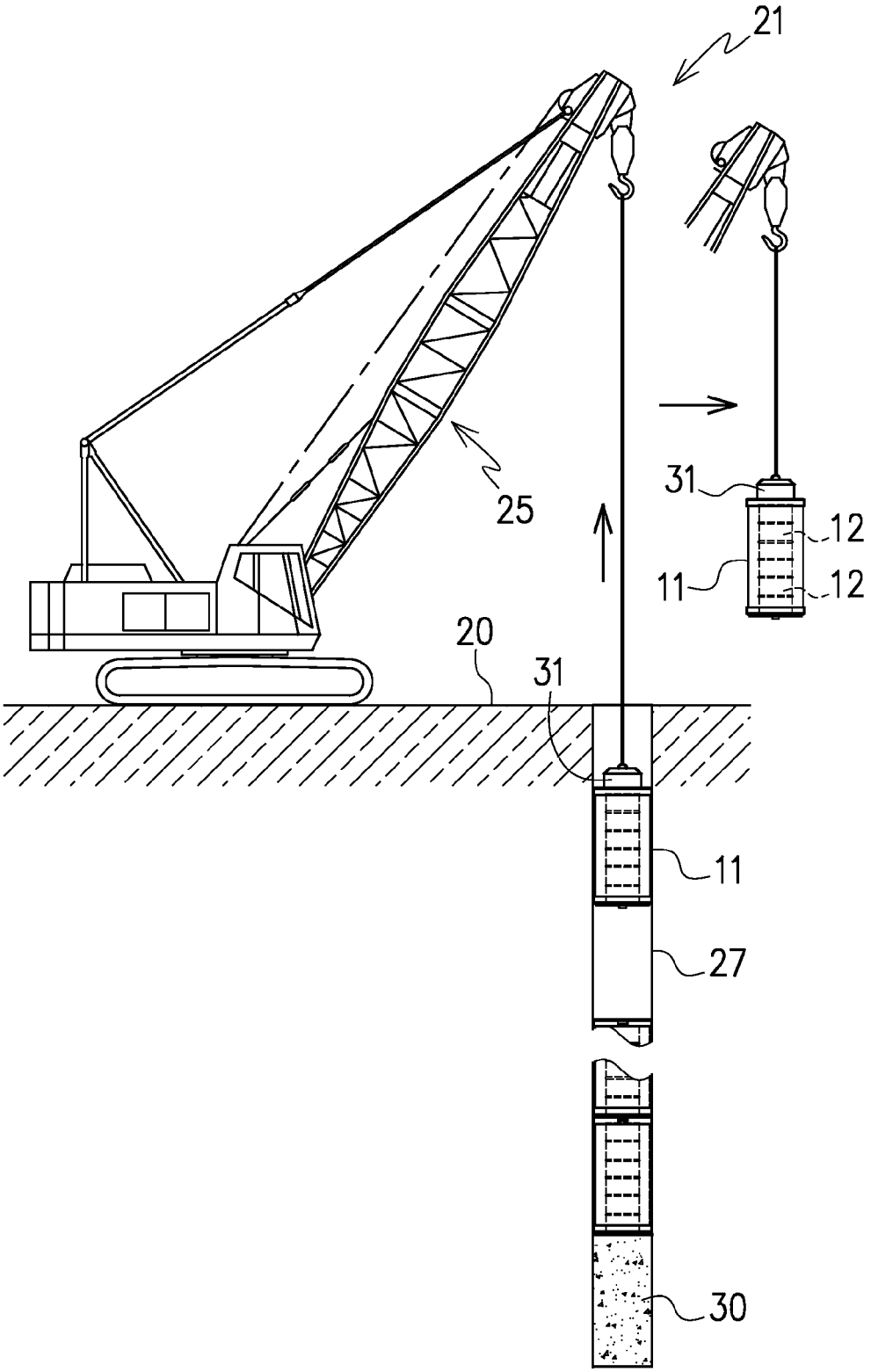
FIG. 11 is a process view showing a method of drawing up the containers for waste storage.

FIGS. 10 and 11 illustrate a drawing-up process of drawing up the containers 11 for waste storage buried by the foregoing processes and reprocessing the containers 11 by moving them on another place. First, the concrete 34 sealing the upper portion of the steel pipe 27 is broken by inserting a drilling casing 35 into a place where the steel pipe is buried and drilling the concrete, and then the lastly buried uppermost container for waste storage is exposed and drawn up.

Thereafter, the electromagnetic absorption portion 31 suspended by the crane 25 is lowered and inserted in the steel pipe 27 and absorbs the lid portion 15 of the container 11 for waste storage, and draws up the container 11. As mentioned above, in the container 11 for waste storage, the upper end and the lower end of the outer surface of the body portion 14, and the circumferential portion of the outer surface of the bottom portion 13 are covered with the rubber member 18. Therefore, the containers 11 for waste storage are easy to be separated from the downward adjacent container and the inner wall surface of the steel pipe 27. In addition, by an adjustment of adsorption force of electromagnetic absorption portion 31, the containers 11 for waste storage can be drawn up one by one easily.

After all the containers 11 for waste storage are drawn up, then the steel pipe 27 is drawn up, and concrete is poured into the vertical hole 26 to fill it with the concrete, thereby the filled vertical hole can be re-used as foundation of conventional buildings. In addition, the filled vertical hole, or a land can be prepared as a square, a park and so on.

As mentioned above, according to the method for waste burial of the present invention, the construction to ensure a burial place of wastes can be achieved by use of the same equipment or process as in the foundation construction of the conventional building. Furthermore, because the plurality of containers for waste storage each containing hermetically wastes can be carried in a stacked state in the steel pipe inserted in the vertical hole which is deeply drilled in the ground. Consequently, it is possible to ensure a burial place to the minimum. In addition, because the waste is sealed by a triple structure of the drum can, the container for waste storage, and the steel pipe and buried in the ground with a predetermined depth by solidifying with the concrete, the waste does not leak to an outside as long as the waste is not high level radioactive.

Furthermore, because the containers for waste storage are disposed in the steel pipe in the stacked state, it is possible to easily draw up the containers for waste storage one by one by an electromagnetic absorption force by removing the concrete portion formed to a predetermined depth from the ground.

In the method for burial according to the embodiment of the present invention, it is considered that a large amount of nubbles containing radioactive substances leaked out from an atomic generator broken by earthquake can be treated rapidly. The method is also suitable in a case of treating usual wastes generated in a conventional production process of a factory, a business place and so on at a low cost and in a short period.

DESCRIPTION OF REFERENCE NUMBERS

11 container for waste storage
12 drum can (sealed case)

13 bottom portion
14 body portion
15 lid portion
16 engagement convex portion
17 engagement concave portion
18 rubber member
20 ground
21 equipment for foundation construction
22 casing
23 casing fixing member
24 hammer grab
25 crane
26 vertical hole
27 steel pipe
28 tremie pipe
29 drainage pipe
30 concrete base
31 electromagnetic absorption portion
32 water stop protrusion
33 sealing cover
34 concrete
35 drilling casing

The invention claimed is:

1. A method for waste burial, comprising:

preparing a plurality of metallic containers for waste storage each being configured to contain a plurality of sealed cases waste being contained in each of the sealed cases and the containers being sealed;

drilling a vertical hole to bury the plurality of containers for waste storage in a ground, thereafter disposing in the vertical hole a steel pipe provided with ring-shaped water stop protrusions along an inner circumferential surface of the steel pipe at a lower portion of the steel pipe;

providing a concrete base on the lower portion of the steel pipe, thereafter disposing the container for waste storage on the concrete base, and thereon stacking the plurality of containers for waste storage; and sealing an upper portion of the uppermost container for waste storage with concrete, after stacking the containers for waste storage from the ground to a predetermined depth.

2. The method for waste burial according to claim 1, wherein the plurality of sealed cases each containing the waste are arranged in the container for waste storage in a stacked state.

3. The method for waste burial according to claim 1, wherein the steel pipe is disposed into the vertical hole along an inner wall surface of a casing when drawing the casing from the vertical hole after the vertical hole is drilled by a hammer grab while driving the casing in the ground.

4. The method for waste burial according to claim 1, wherein when sealing the upper portion of the uppermost container for waste storage with concrete, disposing a sealing lid portion on the uppermost container for waste storage, and thereon applying concrete to seal the container.

5. The method for waste burial according to claim 4, wherein after removing the concrete sealing the upper portion of the uppermost container for waste storage and the sealing lid portion, the containers for waste storage being stacked in the steel pipe are drawn up by a crane.

6. The method for waste burial according to claim 1, wherein the water stop protrusions are provided at predetermined intervals in an up and down direction on the inner circumferential surface of the steel pipe.

7. The method for waste burial according to claim 1, wherein the containers for waste storage are carried in and drawn up from the steel pipe with electromagnetic absorption force of an electromagnetic absorption portion being suspended by a crane.

8. The method for waste burial according to claim 7, further comprising a rubber member provided on at least a part of an outer surface of the containers for waste storage, wherein when transmitting the containers for waste storage by the electromagnetic force, the rubber member of the container is in contact with the inner circumferential surface of the steel pipe or other container to prevent the transmitted container being absorbed to the inner circumferential surface of the steel pipe or the other container.

9. The method for waste burial according to claim 5, wherein the containers for waste storage are carried in and drawn up from the steel pipe with electromagnetic absorption force of an electromagnetic absorption portion being suspended by a crane.

10. The method for waste burial according to claim 9, further comprising a rubber member provided on at least a part of an outer surface of the containers for waste storage, wherein when transmitting the containers for waste storage by the electromagnetic force, the rubber member of the container is in contact with the inner circumferential surface of the steel pipe or other container to prevent the transmitted container being absorbed to the inner circumferential surface of the steel pipe or the other container.

* * * * *